US008262546B1

(12) United States Patent
Lashinske et al.

(10) Patent No.: US 8,262,546 B1
(45) Date of Patent: Sep. 11, 2012

(54) INERTIAL WEIGHT FOR PHYSICAL CONDITIONING

(76) Inventors: Charles Mark Lashinske, Phoenix, AZ (US); Derek Donald Steveson, Phoenix, AZ (US)

( * ) Notice: Subject to any disclaimer, the term of this patent is extended or adjusted under 35 U.S.C. 154(b) by 139 days.

(21) Appl. No.: 11/856,051

(22) Filed: Sep. 16, 2007

(51) Int. Cl.
*A63B 21/06* (2006.01)

(52) U.S. Cl. ..... 482/110; 482/109

(58) Field of Classification Search ..... 482/110, 482/109, 22, 93
See application file for complete search history.

(56) References Cited

U.S. PATENT DOCUMENTS

| | | | | | |
|---|---|---|---|---|---|
| 325,987 | A | * | 9/1885 | Johnson | 482/109 |
| 1,177,505 | A | * | 3/1916 | Fleming | 403/182 |
| 1,190,831 | A | * | 7/1916 | Werner | 607/149 |
| 1,245,965 | A | * | 11/1917 | Pratt | 63/38 |
| 1,259,889 | A | * | 3/1918 | Mackdonald | 446/409 |
| 1,702,991 | A | * | 2/1929 | Bechmann | 601/132 |
| 2,509,810 | A | * | 5/1950 | Core, Jr. | 482/108 |
| 2,547,886 | A | * | 4/1951 | Poux | 607/112 |
| 2,941,219 | A | * | 6/1960 | Irving | 441/56 |
| 3,135,512 | A | * | 6/1964 | Taylor | 273/109 |
| 3,211,457 | A | * | 10/1965 | Dreyer | 273/115 |
| 3,236,521 | A | * | 2/1966 | Knott | 473/457 |
| 3,482,835 | A | | 12/1969 | Dean | |
| 3,509,660 | A | * | 5/1970 | Seymour | 446/38 |
| 3,554,542 | A | * | 1/1971 | Span et al. | 273/453 |
| 3,707,842 | A | * | 1/1973 | Spivak | 368/94 |
| 3,756,592 | A | * | 9/1973 | Johnson | 482/110 |
| 3,843,117 | A | * | 10/1974 | Johnson | 482/110 |
| 3,889,308 | A | * | 6/1975 | Persson | 441/56 |
| 3,904,197 | A | * | 9/1975 | Canonge | 482/81 |
| 4,014,545 | A | * | 3/1977 | Keim | 473/465 |
| 4,052,982 | A | * | 10/1977 | Ozeryansky | 601/121 |
| 4,090,705 | A | * | 5/1978 | Young | 482/82 |
| 4,113,257 | A | * | 9/1978 | Moffatt | 473/143 |
| 4,148,479 | A | * | 4/1979 | Spector | 482/112 |
| 4,218,057 | A | * | 8/1980 | Wilson | 482/93 |
| 4,248,421 | A | * | 2/1981 | Salazar | 482/112 |
| 4,274,639 | A | * | 6/1981 | Flanders | 273/402 |
| D263,416 | S | * | 3/1982 | Saire et al. | D24/206 |
| 4,378,113 | A | * | 3/1983 | Piccini | 482/110 |
| 4,384,369 | A | | 5/1983 | Prince | |
| 4,474,481 | A | * | 10/1984 | Croyle | 368/93 |
| 4,518,162 | A | * | 5/1985 | Oates | 482/93 |
| 4,538,806 | A | * | 9/1985 | Wilkerson | 482/108 |
| 4,659,078 | A | * | 4/1987 | Blome | 482/110 |
| 4,828,256 | A | * | 5/1989 | Lee | 482/106 |
| 4,836,818 | A | * | 6/1989 | Piolata | 446/236 |
| 4,988,093 | A | * | 1/1991 | Forrest et al. | 482/10 |

(Continued)

OTHER PUBLICATIONS

Taper definition pdf file from- http://www.merriam-webster.com/dictionary/tapering.*

*Primary Examiner* — Stephen Crow
(74) *Attorney, Agent, or Firm* — Weiss & Moy, P.C.; Veronica-Adele R. Cao

(57) ABSTRACT

An inertial weight for physical conditioning includes a hollow housing having an inner cavity with first and second spaced apart opposed ends and defining a longitudinal axis extending therebetween. The inner cavity tapers transversely outwardly along the longitudinal axis from a mid section to each of the first and second spaced apart opposed ends. A viscous fluid mass is carried in the inner cavity, the viscous mass filling the inner cavity less than full to allow the viscous mass to move within the inner cavity. An attachment member is affixed to at last one of the opposed ends.

15 Claims, 6 Drawing Sheets

U.S. PATENT DOCUMENTS 5,056,778 A * 10/1991 Hull et al. ..... 482/105
5,069,208 A * 12/1991 Noppel et al. ..... 607/114
5,114,371 A * 5/1992 Alonzo ..... 441/129
5,183,453 A 2/1993 Yamashiro
5,184,993 A * 2/1993 Dowdeswell ..... 482/106
5,222,929 A 6/1993 Duda
5,237,903 A * 8/1993 Bein et al. ..... 84/404
5,242,348 A * 9/1993 Bates ..... 482/105
5,244,445 A * 9/1993 Amesquita ..... 482/110
5,316,531 A * 5/1994 Spence ..... 482/93
5,344,375 A * 9/1994 Cooper ..... 482/106
5,393,285 A * 2/1995 Fischer et al. ..... 482/108
5,431,615 A * 7/1995 Correll ..... 482/108
5,445,587 A * 8/1995 Brown ..... 482/108
5,492,526 A * 2/1996 Chen ..... 601/132
5,524,863 A * 6/1996 Davis ..... 251/127
5,599,021 A * 2/1997 Lary et al. ..... 473/219
5,699,779 A * 12/1997 Tidman ..... 124/6
5,813,946 A * 9/1998 Lin et al. ..... 482/27
5,820,531 A * 10/1998 Choi ..... 482/93
5,897,469 A * 4/1999 Yalch ..... 482/109
5,950,608 A * 9/1999 Tidman ..... 124/6
6,068,580 A * 5/2000 Myers et al. ..... 482/93
6,074,413 A * 6/2000 Davis et al. ..... 607/108
6,165,040 A * 12/2000 Burich ..... 446/242
6,190,292 B1 * 2/2001 Panes ..... 482/93
6,217,495 B1 * 4/2001 Yalch ..... 482/109
6,241,637 B1 * 6/2001 Basyuk ..... 482/44
6,379,288 B1 * 4/2002 Liu ..... 482/105
D459,377 S * 6/2002 Glick ..... D16/135
6,431,939 B1 * 8/2002 Roh et al. ..... 446/236
6,482,136 B1 * 11/2002 Kessler ..... 482/110
6,494,760 B1 * 12/2002 Kessler ..... 446/236
6,514,179 B1 * 2/2003 Yu ..... 482/44
6,547,703 B1 * 4/2003 Swezey et al. ..... 482/91
6,569,035 B2 * 5/2003 Binette et al. ..... 473/373
6,595,827 B2 * 7/2003 Kirley ..... 446/219
6,652,421 B1 * 11/2003 Chen ..... 482/49
6,755,096 B2 * 6/2004 Schroder ..... 81/20
6,780,144 B2 * 8/2004 Stevens ..... 482/91
6,814,645 B2 * 11/2004 Kuk ..... 446/236
6,890,238 B2 * 5/2005 Kessler ..... 446/236
6,966,814 B2 * 11/2005 Mendel ..... 446/236
6,981,933 B2 1/2006 Scafidel
7,056,269 B2 * 6/2006 Cleveland et al. ..... 482/148
7,163,495 B2 * 1/2007 Fazio et al. ..... 482/112
7,179,210 B2 * 2/2007 Soukeras ..... 482/109
7,250,022 B2 * 7/2007 Dalebout et al. ..... 482/142
7,285,080 B1 * 10/2007 Chiu ..... 482/142
D556,841 S * 12/2007 Oates ..... D21/679
7,303,458 B1 * 12/2007 Wolfinbarger ..... 446/236
D566,205 S * 4/2008 Oates ..... D21/662
7,470,845 B2 * 12/2008 Fermie et al. ..... 84/402
2002/0160890 A1 * 10/2002 Fazio et al. ..... 482/112
2003/0017920 A1 * 1/2003 Fazio et al. ..... 482/112
2003/0228829 A1 * 12/2003 Falk ..... 446/475
2004/0067826 A1 4/2004 Elledge
2004/0266313 A1 * 12/2004 Kessler ..... 446/236
2005/0070202 A1 * 3/2005 Mendel ..... 446/236
2005/0095950 A1 * 5/2005 Mendel ..... 446/236
2005/0239614 A1 * 10/2005 Herder ..... 482/110
2006/0079383 A1 * 4/2006 Hermans ..... 482/109
2006/0094324 A1 * 5/2006 Kelley ..... 446/15
2006/0240741 A1 * 10/2006 Kessler ..... 446/236
2007/0184941 A1 * 8/2007 Krietzman ..... 482/93
2007/0184942 A1 * 8/2007 Krietzman ..... 482/93
2008/0153383 A1 * 6/2008 Mendel ..... 446/236

* cited by examiner

INERTIAL WEIGHT FOR PHYSICAL CONDITIONING

FIELD OF THE INVENTION

This invention generally relates to apparatus for physical conditioning and more specifically to an inertial weight for physical conditioning.

BACKGROUND OF THE INVENTION

During exercising or physical training and therapy, static or fixed weights are traditionally used. One problem with these weights is that they do not stretch or expand the exercise but limit the exercise to the actual movements made by the person doing the exercise. Thus, for example, to further extend an exercise for rehabilitation, trimming, shaping, toning, or conditioning, the person must move farther, stretching the muscles and tendons.

Many different types of devices have been devised or proposed to perform this extending action. Generally, these devices include some type of dynamic or movable weight that shifts as the device is moved in one direction. Generally, the weights are either fluid or solid but in all known instances the device is designed so that the moving material strikes an end wall at the end of the movement to produce a sharp impact or pull in the moving direction. This sharp pull or impact can produce an undesirable strain on the muscles.

It would be highly advantageous, therefore, to remedy the foregoing and other deficiencies inherent in the prior art.

Accordingly, it is an object of the present invention to provide a new and improved inertial weight for physical conditioning.

It is another object of the present invention to provide a new and improved inertial weight that produces a cumulative pulling at the end of a movement.

SUMMARY OF THE INVENTION

The above objects and others are realized in an inertial weight for physical conditioning including a hollow housing having an inner cavity with first and second spaced apart opposed ends and defining a longitudinal axis extending therebetween. The inner cavity tapers transversely outwardly along the longitudinal axis from a mid section to each of the first and second spaced apart opposed ends. A viscous mass is carried in the inner cavity, the viscous mass filling the inner cavity less than full to allow the viscous mass to move within the inner cavity. An attachment member is affixed to at least one of the opposed ends. The curved formation of the inner cavity of the housing and the viscous mass produce a smooth and gentle accumulation of weight at the end of the movement rather than the sharp pull or jar produced in prior art devices.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF A PREFERRED EMBODIMENT

Figure 1:
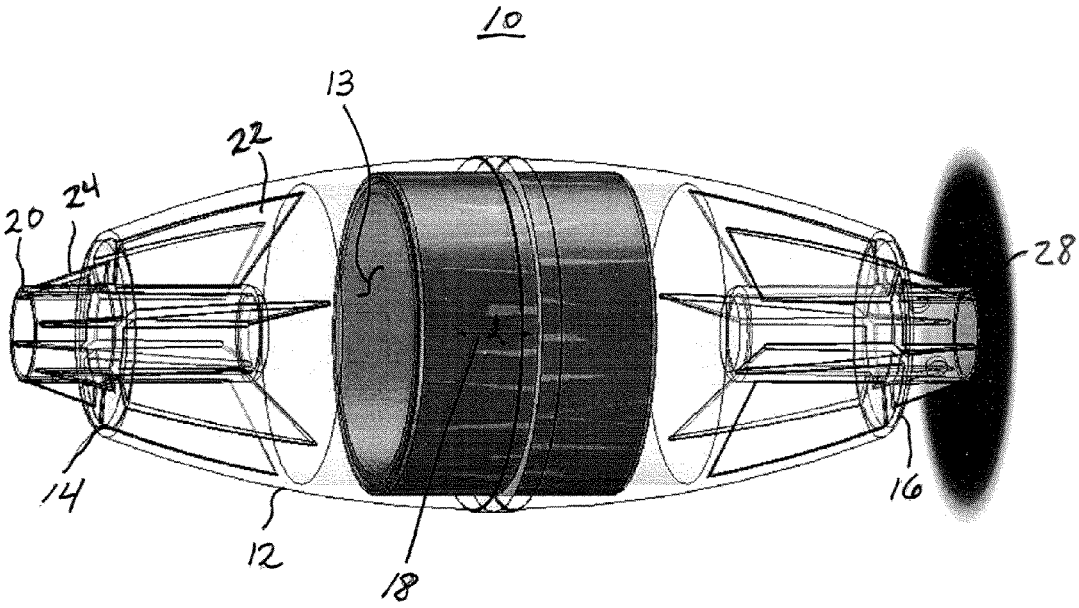
FIG. 1 is a view in perspective of an inertial weight in accordance with the present invention.
Figure 2:
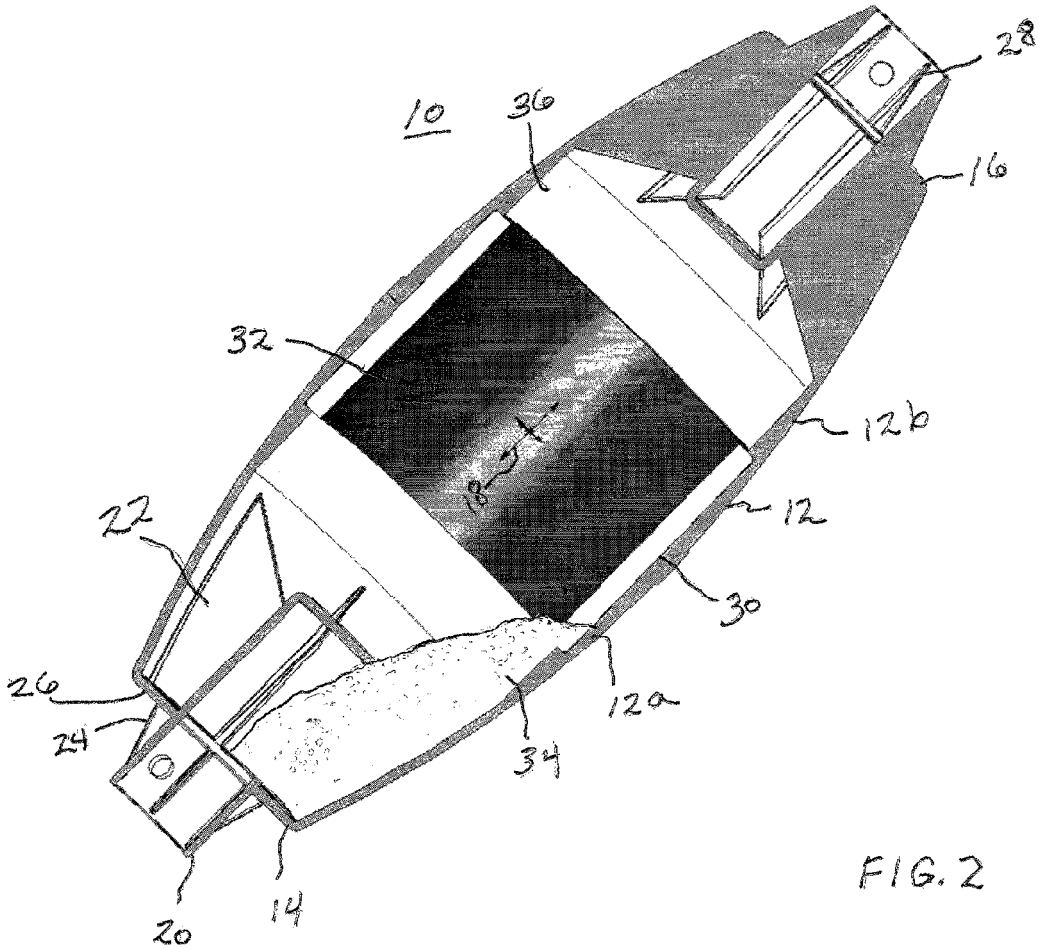
FIG. 2 is a side elevational view of the inertial weight of FIG. 1.

Turning now to the drawings, attention is first directed to FIGS. 1 and 2 which illustrate an inertial weight 10 in accordance with the present invention. Inertial weight 10 includes a hollow housing 12 defining an inner cavity 13 with first and second spaced apart opposed ends 14 and 16. A longitudinal axis 18 is defined extending therebetween. Inner cavity 13 tapers transversely outwardly along longitudinal axis 18 from a mid section to each of the first and second spaced apart opposed ends 14 and 16. In this preferred embodiment, inertial weight 10 includes housing 12 being generally ellipsoidal shaped with truncated opposed ends 14 and 16. More specifically, longitudinal axis 18 extends from end 14 to the opposed end 16 thereof with the radius of the housing (direction transverse to longitudinal axis 18) gradually tapering or decreasing in length from a midsection toward ends 14 and 16.

Each end 14 and 16 is provided with an attachment member to allow various elements to be attached, such as bars, multiple weight elements, etc. In this specific embodiment, the attachment member at end 14 is a handle receiving cylindrical socket 20 extending longitudinally into housing 12. The end of socket 20 within housing 12 is closed and the end of socket 20 outside of housing 12 is open. Radially outwardly extending fins 22 are attached to the outer surface of socket 20 within housing 12 and extend into engagement with the inner surface of housing 12. In this embodiment additional fins 24 are also attached to the outer surface of socket 20 outside of housing 12. Both fins 22 and fins 24 are also attached to an end wall 26 of housing 12. Fins 22 and 24 provide stability and strength for socket 20 when a handle is inserted therein, as will be explained in more detail presently. An attachment member at end 16, in this embodiment, includes a similar handle receiving socket 28 attached to end 16 which, because of its similarity will not be discussed in detail.

In this embodiment, housing 12 is formed in two halves 12*a* and 12*b* that are joined at a midsection 30 by some convenient means, such as threadedly engaged, adhesives, snap fit, etc. Also, in this specific embodiment, an optional cylindrical insert 32 is positioned coaxially within housing 12 so as to extend substantially beyond midsection 30 in both longitudinal directions. Insert 32 is provided to aid in fastening halves 12*a* and 12*b* together and strengthen midsection 30.

Still referring to FIG. 2, a viscous mass 34 is carried within inner cavity 13. The volume of viscous mass 34 will vary depending on the desired weight of inertial weight 10. Illustrated is a smaller portion for less weight. Typically the weight can range from 1 pound (approximately the amount illustrated) to 15 pounds, which will less than fill one of halves 12*a* and 12*b*. More weight is typically undesirable for the beneficial exercises in which the device is employed. Viscous mass 34 is a mixture of a viscous fluid, such as oil and the like, and weight particles, such as lead pellets, steel shot and the like. Generally rounded shot of some dense material such as metal is employed. The desired characteristic of the weight particles employed is fluidity, wherein each particle separates readily from its neighbor and will flow. This fluidity is witnessed, for example, when shot is poured from a container in a stream of individual particles. In the present invention, weight particles are combined with viscous fluid to create viscous mass 34. The desired characteristic of viscous mass 34 is a moderated flow characteristic of weight particles. The amount of viscous fluid employed is determined by the amount necessary to generally coat each particle so that a slight surface cohesion exists between particles. This produces viscous mass 34 which will generally flow but will be generally retained in a cohesive whole. Excessive viscous fluid will result in the fluid pouring from particles, and is again undesirable. As a specific example of viscous mass 34, weight particles preferably include shot sizes from #8 shot to #6 shot as is a standard of measure for shot used in shot shells. For a pound of shot in this size range, approximately 1 table spoon or 16 ml of oil is required for the desired characteristics.

Figure 3:
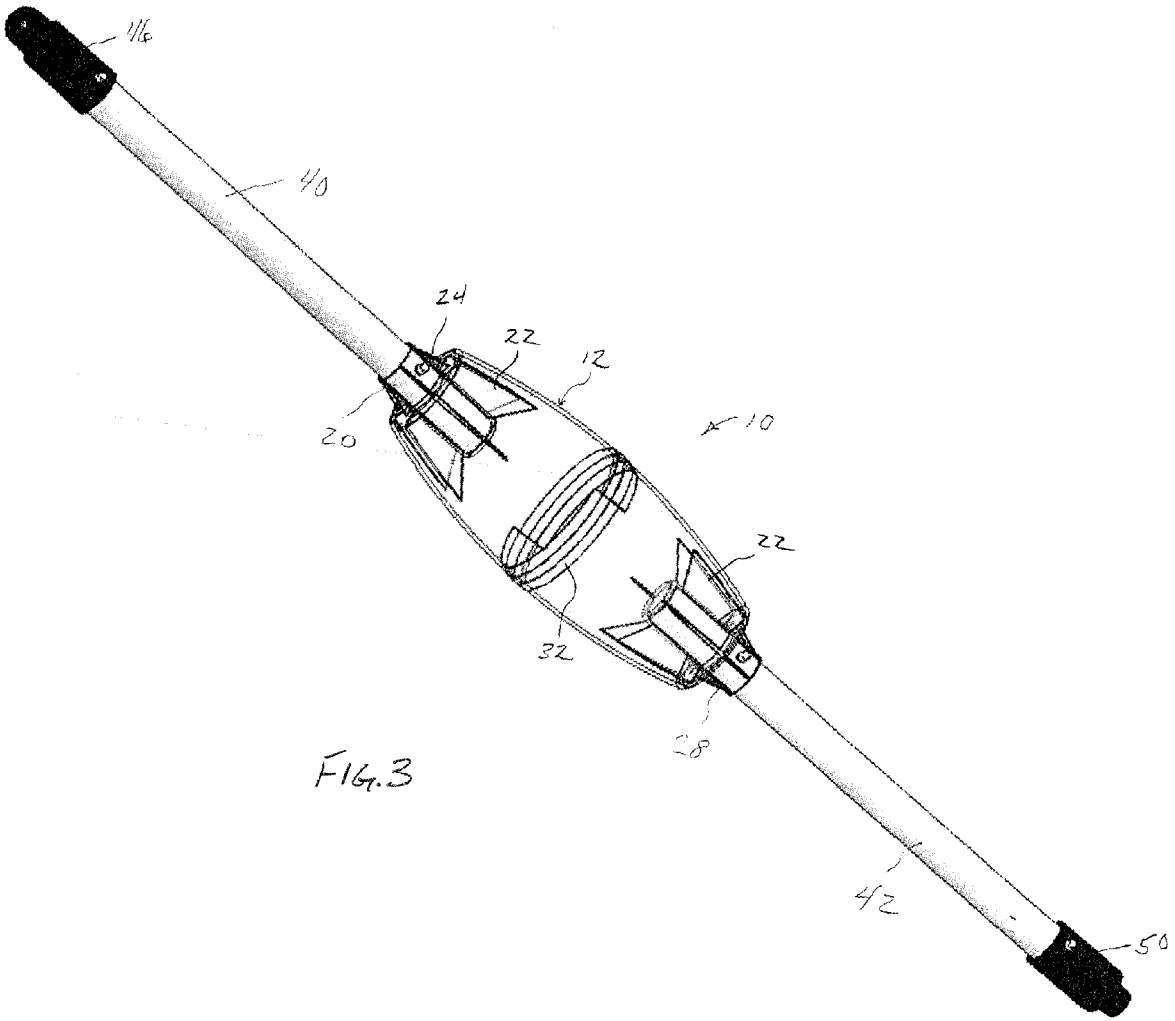
FIG. 3 is a perspective view of the inertial weight of FIG. 1 with handles attached.
Figure 4:
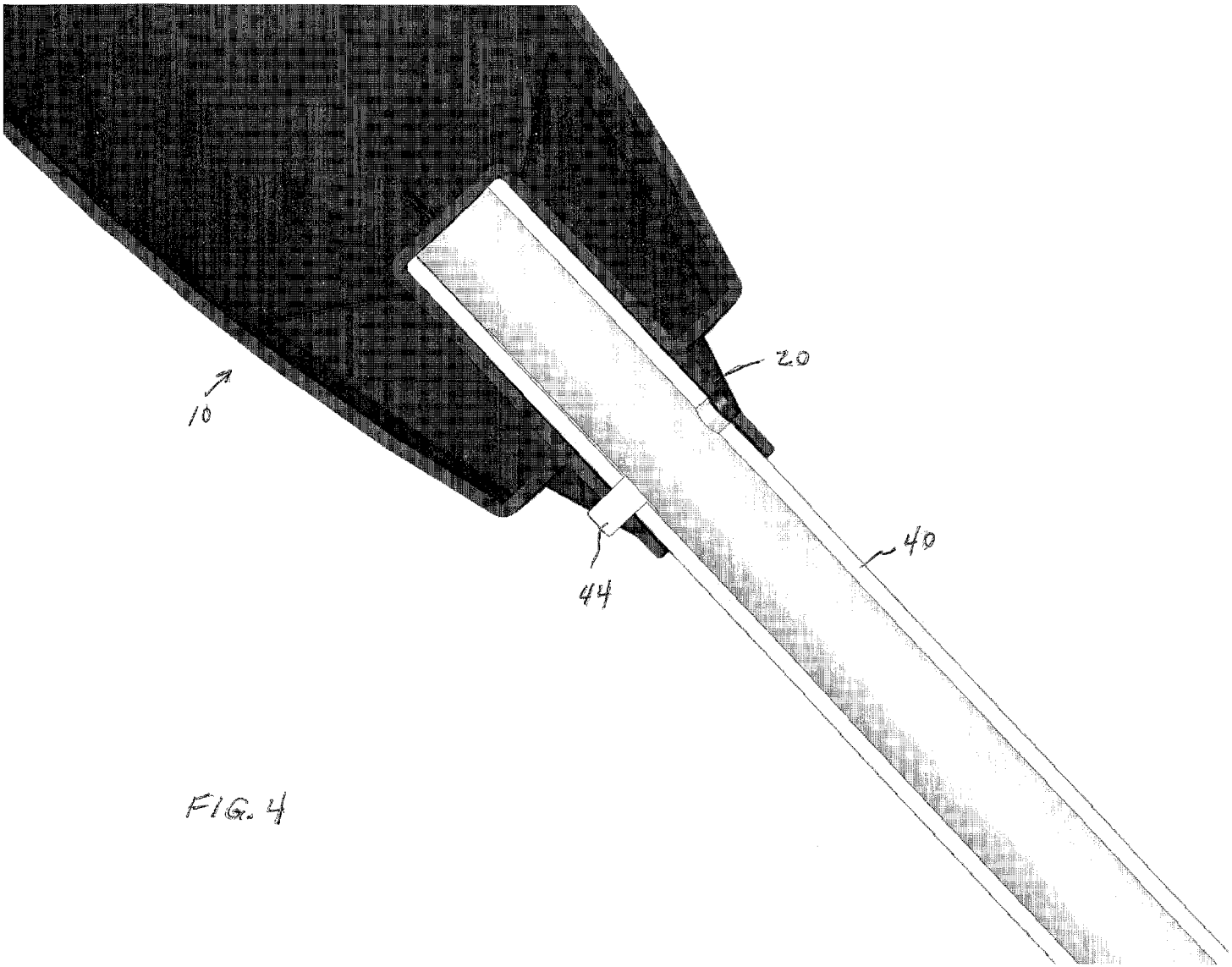
FIG. 4 is an enlarged sectional view illustrating preferred apparatus for attaching the handles.

Referring additionally to FIG. 3, one end of a handle 40 is inserted into the open end of socket 20 and fixed in place by some convenient locking apparatus. Also, one end of a second handle 42 is inserted into the open end of socket 28 and fixed in place by some convenient locking apparatus. Either of handles 40 and 42 may be optional, depending upon the specific use or exercise being performed. Referring additionally to FIG. 4, one type of locking apparatus for fixing either handle 40 or handle 42 in socket 20 or 28 is illustrated. In this preferred embodiment, a spring loaded pin 44 is mounted adjacent the inner end of handle 40. Spring loaded pin 44 is the well known type that extends radially outwardly through openings at opposed ends of a diameter of handle 40. To engage or lock handle 40 in socket 20, spring loaded pin 44 is pushed inwardly and the inner end of handle 20 is inserted coaxially into socket 20. Pin 44 is then allowed to extend outwardly through openings formed in socket 20 to hold handle 40 in place.

Figure 5:
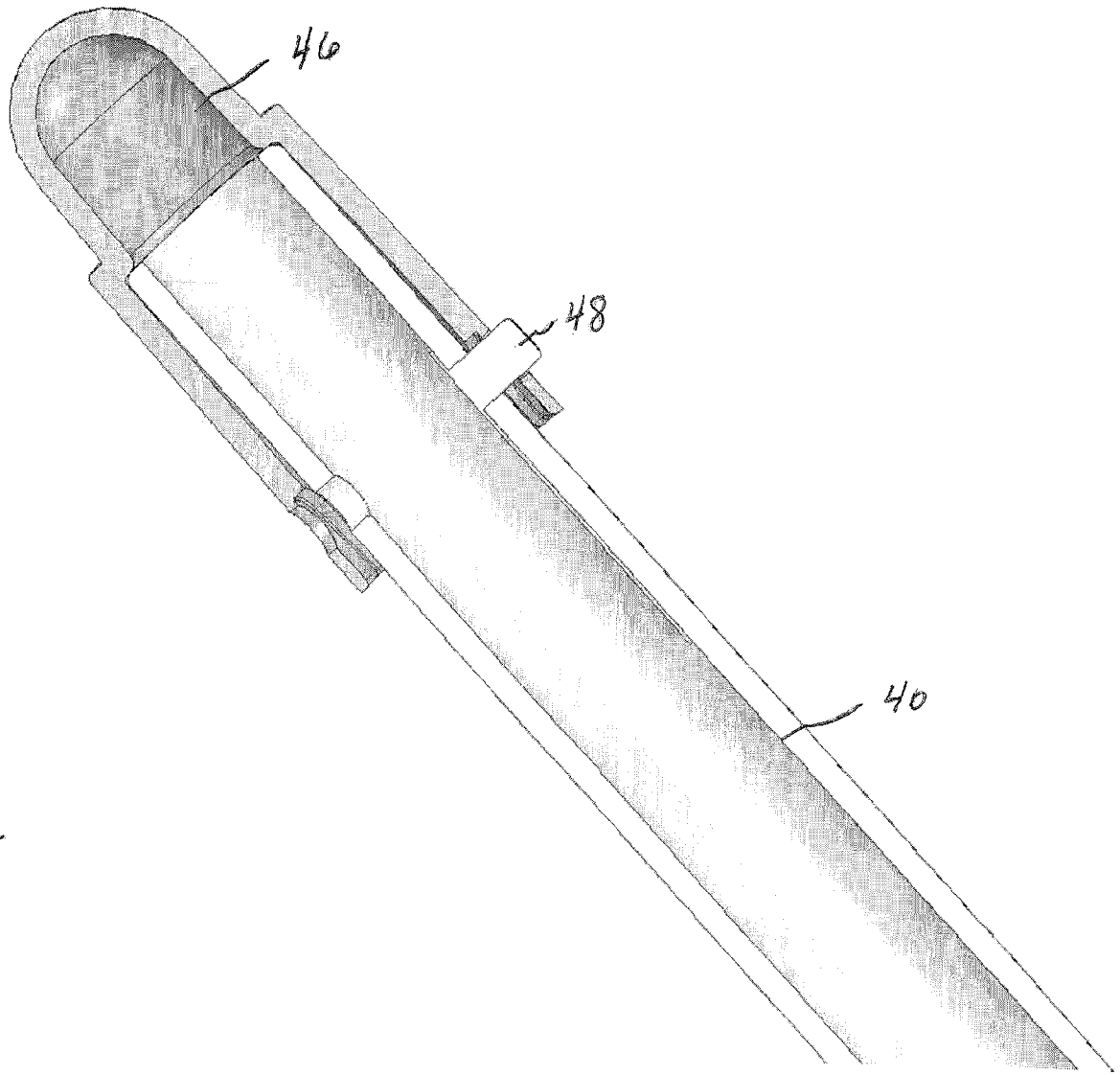
FIG. 5 is an enlarged sectional view illustrating an end of one of the handles.
Figure 6:
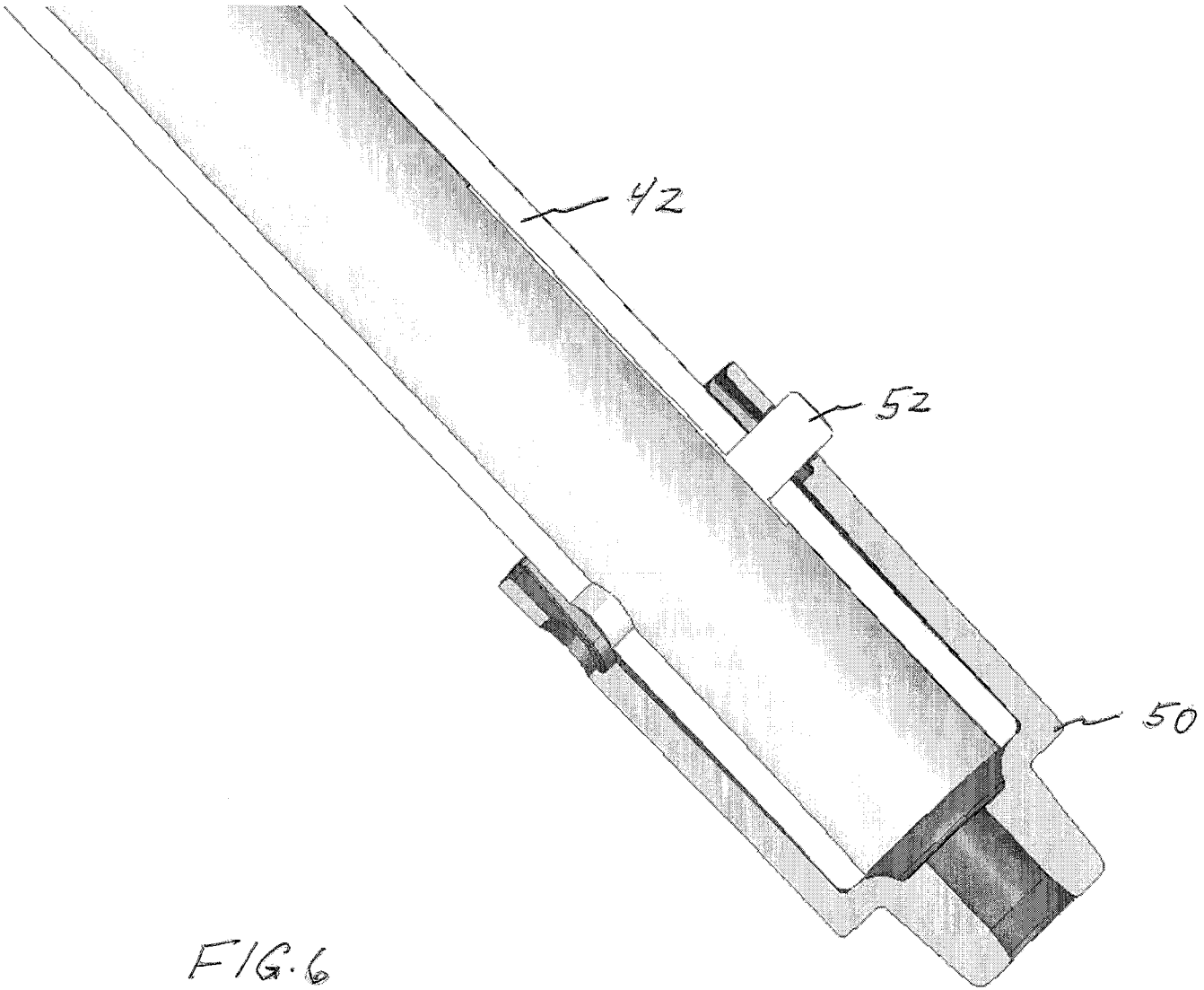
FIG. 6 is an enlarged sectional view illustrating an end of the other of the handles.

As illustrated in FIG. 5, handle 40 has an end cap 46 associated therewith. End cap 46 fits coaxially over the outer end of handle 40 and is fixed in place, in this embodiment, by a spring loaded pin 48 that operates as described above for spring loaded pin 44. Referring additionally to FIG. 6, an end cap 50 is associated with the outer end of handle 42. End cap 50 fits coaxially over the outer end of handle 42 and is fixed in place, in this embodiment, by a spring loaded pin 52 that operates as described above for spring loaded pins 44 and 48. While spring loaded pins 44, 48, and 52 are illustrated and described in this embodiment, it will be understood that many other types of locking apparatus can be devised for both locking handles 40 and 42 in sockets 20 and 28 and the locking pins are illustrated and described because of the ease of installation and convenience in use.

In the use of inertial weight 10, inner cavity 13 is accessed. In this embodiment access is accomplished when the two halves 12*a* and 12*b* are separated. Viscous mass 34, such as described previously, is introduced into inner cavity 13. In this embodiment, to maximize the weight employed, one half of housing 12 is be substantially filled with the combination of viscous fluid and weight particles (viscous mass 34), which, when the two halves are again united into a single unit, will result in slightly less than a half full inner cavity 13. Thus, inner cavity 13 is filled with viscous mass 34 to somewhere less than half full, allowing viscous mass 34 to move within housing 12.

In operation, as inertial weight 10 is moved in a direction parallel to its axis, the combination of fluid and weight particles moves in a direction opposite to the direction of movement. When the movement stops (i.e. at the end of the movement) the combination of fluid and weight particles continue to move to the outermost end of inertial weight 10. Thus, as a movement with inertial weight 10 is performed, at the end of the movement, the combination of fluid and weight particles continue for a split second pushing the movement past the stop point. Because of the curved formation of the inner cavity of housing 12 and characteristics of viscous mass 34, a gentle accumulation of weight occurs at the end of the movement, rather than a sharp jarring impact of a weight against an end wall. Also, fins 22 within the inner cavity prevent whirling or other torque producing movement of the viscous mass so that very little or no twisting movement occurs as a result of the movement of the viscous fluid.

Many other embodiments or uses can be devised for inertial weight 10. For example, in the embodiment described, a single handle (e.g. handle 40) can be attached to inertial weight 10. In this embodiment, inertial weight 10 could be swung, for example, as a ball bat or thrust similar to a sword. With both handles 40 and 42 attached inertial weight 10 could be moved from side to side horizontally across the body or raised and lowered vertically, etc. Also, more than one inertial weight can be used in tandem by affixing another inertial weight to the outer end of either handle 40 and/or handle 42 in place of end cap 46 or 50.

Thus, a new and improved inertial weight has been disclosed that provides a smooth accumulation of weight at the end of a movement, thereby keeping the body expanding past its initial limits and pushing the movement past the stop point and pushing the body that increment further. Further, the new and improved inertial weight is constructed to prevent a solid jarring as the movement stops because the curved formation of the inner cavity of the housing and the viscous mass produce a smooth and gentle accumulation of weight at the end of the movement.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. An intertial weight for physical conditioning comprising:

a hollow housing having an inner cavity with first and second spaced apart opposed ends and defining a longitudinal axis extending therebetween, the inner cavity tapering transversely outwardly along the longitudinal axis from a mid section to each of the first and second spaced apart opposed ends;

a viscous mass carried in the inner cavity, the viscous mass filling the inner cavity less than full to allow the viscous mass to flow within the inner cavity; and a cylindrical attachment member fixed to at least one of the opposed ends, the cylindrical attachment member having one end extending longitudinally into the housing and having a plurality of fins extending radially and outwardly from the one end of the cylindrical attachment for engaging the inner cavity of the housing.

2. An inertial weight for physical conditioning as claimed in claim 1 wherein the hollow housing and inner cavity are generally ellipsoidal in shape with truncated ends.

3. An inertial weight for physical conditioning as claimed in claim 1 wherein the viscous mass includes weight particles with a coating of viscous fluid.

4. An inertial weight for physical conditioning as claimed in claim 3 wherein the weight particles include shot having a size in the range of #8 to #6.

5. An inertial weight for physical conditioning as claimed in claim 1 wherein the attachment member includes a cylindrical socket attached to one of the first and second ends of the housing.

6. An inertial weight for physical conditioning as claimed in claim 5 wherein the attachment member includes a cylindrical socket attached to each of the first and second ends of the housing.

7. An inertial weight for physical conditioning as claimed in claim 5 wherein the cylindrical socket includes a cylinder with an inner end extending coaxially into the inner cavity and an outer end extending coaxially out of the inner cavity, the cylinder being closed at the inner end and open at the outer end.

8. An inertial weight for physical conditioning as claimed in claim 1 further including an elongated handle having one end engaged to the one of the first and second ends of the housing by the attachment member.

9. An inertial weight for physical conditioning as claimed in claim 8 further including a second inertial weight for physical conditioning comprising:

a second hollow housing having a second inner cavity with first and second spaced apart opposed ends and defining a longitudinal axis extending therebetween, the second inner cavity tapers transversely outwardly along the longitudinal axis from a mid section to each of the first and second spaced apart opposed ends;

a viscous mass carried in the second inner cavity, the viscous mass filling the second inner cavity less than full to allow the viscous mass to flow within the second inner cavity; and a second cylindrical attachment member affixed to at least one of the opposed ends, the elongated handle having a second end engaged to the second attachment member, the second cylindrical attachment member having one end extending longitudinally into the housing and having a plurality of fins extending radially and outwardly from the one end of the second cylindrical attachment for engaging the inner cavity of the housing.

10. An inertial weight for physical conditioning as claimed in claim 1 including a first attachment member affixed the first end of the housing and a second attachment member affixed to the second end of the housing and further including a first elongated handle engaged to the first attachment member and a second elongated handle engaged to the second attachment member.

11. An inertial weight for physical conditioning comprising:

a hollow housing having a cylindrical inner cavity with first and second spaced apart opposed ends and defining a longitudinal axis extending therebetween, the inner cavity tapering transversely outwardly along the longitudinal axis from a mid section to each of the first and second spaced apart opposed ends;

a viscous mass including weight particles with a coating of viscous fluid, the viscous mass carried in the inner cavity, the viscous mass filling the inner cavity less than full to allow the viscous mass to flow within the inner cavity from one of the first and second spaced apart opposed ends to the other during movement of the inertial weight;

a pair of cylindrical attachment members one each affixed to each of the first and second spaced apart opposed ends, each cylindrical attachment member having one end extending longitudinally into the housing and having a plurality of fins extending radially and outwardly from the one end of each of the cylindrical attachments for engaging the inner cavity of the housing.

12. An inertial weight for physical conditioning as claimed in claim 11 wherein the pair of attachment members each including a cylindrical socket having a cylinder with an inner end extending coaxially into the inner cavity and an outer end extending out of the inner cavity, the cylinder being closed at the inner end and open at the outer end.

13. An inertial weight for physical conditioning as claimed in claim 12 further including an elongated handle coaxially engaged in at least one of the cylindrical sockets.

14. An inertial weight for physical conditioning as claimed in claim 11 wherein the weight particles include shot having a size in the range of #8 to #6.

15. An inertial weight for physical conditioning as claimed in claim 11 wherein the housing is filled with the viscous mass less than half full.

* * * * *